United States Patent [19]

Ramm et al.

[11] Patent Number: 4,808,337

[45] Date of Patent: Feb. 28, 1989

[54] HOT PRESSING OF BELLOWS LIKE CANISTERS

[76] Inventors: Eric J. Ramm, 10 Immarna Street, Lilli Pilli, N.S.W. 2229; Wilhelmus J. Bukyx, 12 Newland Place, Engadine, N.S.W. 2233; John G. Padgett, 45 Waratah Road, Engadine, N.S.W. 2233; Alfred E. Ringwood, 3 Vancouver Street, Redhill, A.C.T. 2603, all of Australia

[21] Appl. No.: 884,981

[22] Filed: Jul. 14, 1986

[30] Foreign Application Priority Data

Jul. 16, 1985 [AU] Australia ..... PH01498

[51] Int. Cl.[4] ..... G21F 9/16; G21F 9/12

[52] U.S. Cl. ..... 252/628; 250/506.1; 252/629; 252/633; 264/332; 419/48; 419/51

[58] Field of Search ..... 252/628, 633, 629, 627, 252/631, 635; 501/12; 100/104, 110, 125, 126; 250/506.1, 507.1; 264/125, 332.3, 319; 419/48, 51

[56] References Cited

U.S. PATENT DOCUMENTS

| | | | |
|---|---|---|---|
| 2,852,141 | 9/1958 | Landon | 100/126 |
| 3,705,648 | 12/1972 | Arvanitakis | 100/126 |
| 4,172,807 | 10/1979 | Larker | 252/633 |
| 4,274,976 | 6/1981 | Ringwood | 252/629 |
| 4,314,909 | 2/1982 | Beall et al. | 252/629 |
| 4,409,029 | 10/1983 | Larker et al. | 252/633 |
| 4,590,000 | 5/1986 | Baatz et al. | 252/633 |
| 4,645,624 | 2/1987 | Ramm et al. | 252/628 |

FOREIGN PATENT DOCUMENTS

| | | | |
|---|---|---|---|
| 0115311 | 8/1984 | European Pat. Off. | 252/633 |
| 0196199 | 12/1982 | Japan | 252/628 |

OTHER PUBLICATIONS

Walgate, R. 1982, Synroc presses on in Australia, Nature 300(9): 470.

*Primary Examiner*—Stephen J. Lechert, Jr.
*Assistant Examiner*—Howard J. Locker
*Attorney, Agent, or Firm*—Ladas & Parry

[57] ABSTRACT

A compressible bellows type metal canister is used in a hot pressing process for immobilizing high level radioactive nuclear waste material in the form of synthetic rock, the canister comprises a base wall and a corrugated bellows side wall of generally circular cross-section, concentrically arranged within the corrugated side wall is a cylindrical liner. In the center of the base wall a conically-tapered aperture is provided with a filter plug. Diametrically opposed apertures are provided in the base wall and are connected by an outlet pipe for removal of waste gases.

9 Claims, 2 Drawing Sheets

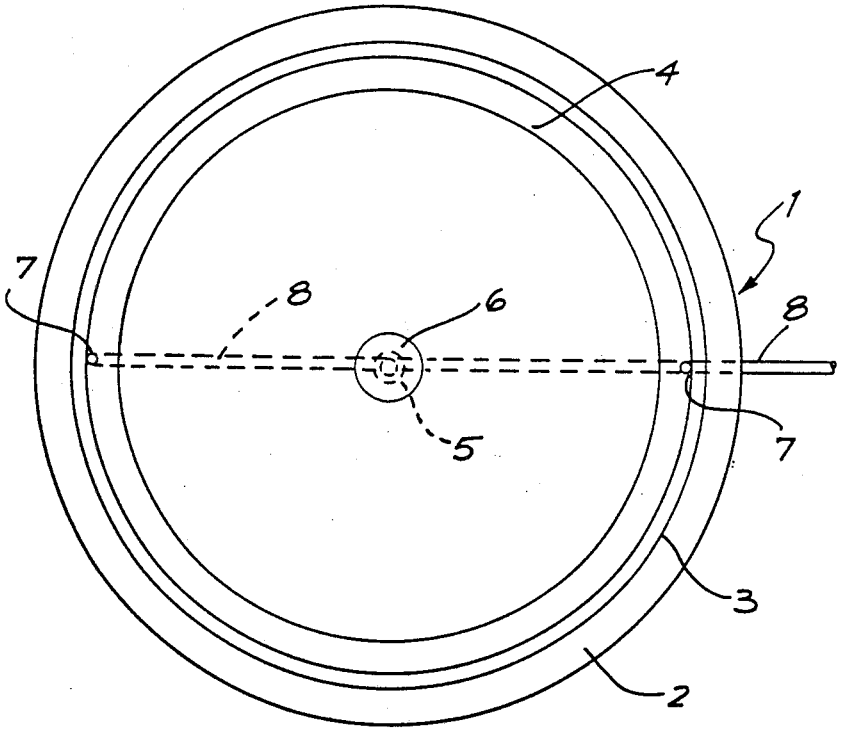
FIG. 1
FIG. 2
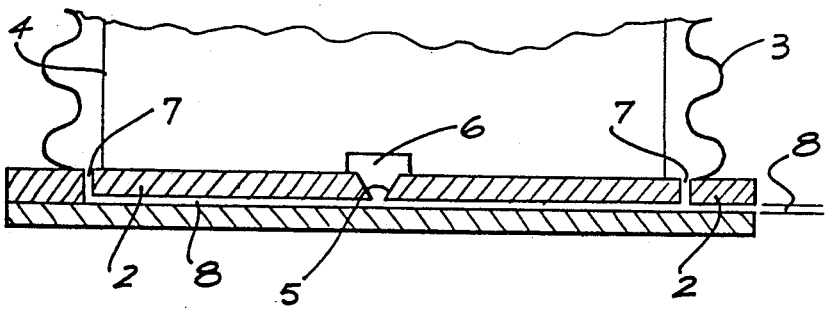

FIG. 3A
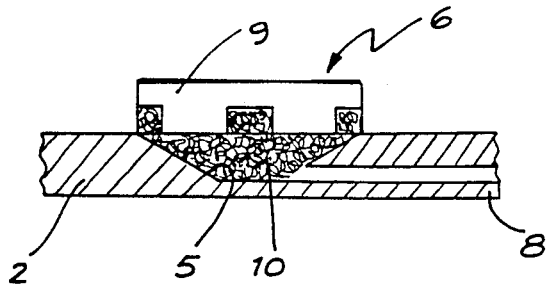
FIG. 3B
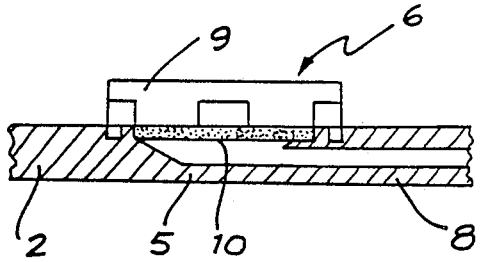
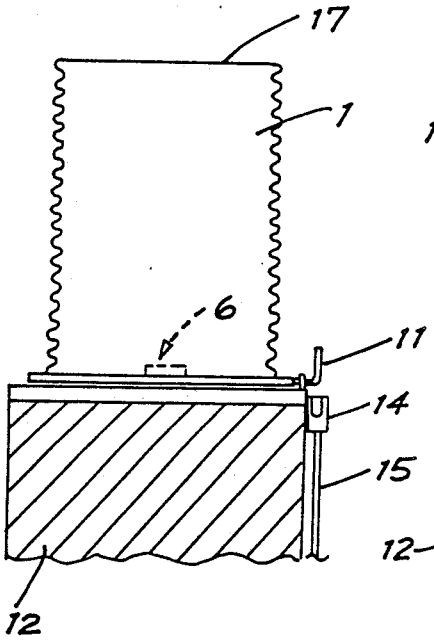
FIG. 4A
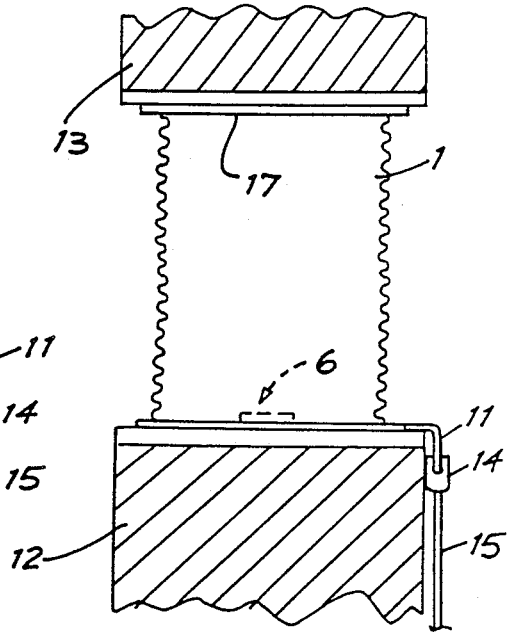
FIG. 4B

HOT PRESSING OF BELLOWS LIKE CANISTERS

FIELD OF THE INVENTION

The present invention relates to removal of gases from a compressible, substantially closed container during hot uniaxial pressing and, in particular but not exclusively, is related to such a method for use in a process for immobilising high level radioactive nuclear waste material in a synthetic rock formed under heat and high pressure from an intimate mixture of such a waste material and synthetic rock-forming material.

BACKGROUND OF THE INVENTION

Radioactive waste materials and synthetic rock precursor may be poured into a compressible, bellows-type canister which is closed and then subjected to hot uniaxial pressing such as described in our U.S. patent application Ser. No. 524,841 now U.S. Pat. No. 4,645,624, assigned to the assignee of the present application.

A known alternative to the present applicants' hot uniaxial pressing process is a hot isostatic processing in which the particulate waste material and synthetic rock forming material is placed in a metal container which needs to be evacuated and completely sealed. This metal container is then subjected to high temperatures with a very high surrounding gas pressure to cause compaction of the material within the canister as it forms a synthetic rock. Thus the canister is supported on all sides by the gas pressure and the very nature of the process is such that any gaseous material within the container must be retained therein. When a canister is filled with the particulate mixture (for forming the synthetic rock incorporating radioactive waste) even if a high filling density is achieved there will be a considerable quanitity of gas in the interstices of the mixture, unless the gas is completely evacuated, a time consuming and complex process in an active cell.

SUMMARY OF THE INVENTION

The present invention concerns a development of the process of hot uniaxial pressing of the present applicants and in contrast to the hot isostatic pressing process proposes an arrangement whereby gases occuring within the container are removed in a controlled manner.

According to a first aspect of the invention, there is provided a method of forming synthetic rock incorporating radioactive waste wherein precursor materials for the synthetic rock mixed with radioactive waste are placed in a metal canister, the wall of which includes a bellows like wall structure, the method comprising heating the canister and its contents and maintaining a sufficiently elevated temperature during the application of axial pressure to the canister to cause the formation of synthetic rock and the discharge of gases, and characterised by using a canister including a discharge duct connected to an exhaust gas processing system for discharging gases from within the canister.

The invention also extends to a method of forming synthetic rock incorporating radioactive waste wherein precursor materials for the synthetic rock mixed with radioactive waste are placed in a generally cylindrical metal canister, the cylindrical wall of which includes a bellows-like structure and the canister includes a discharge duct for discharging gases therefrom, the method comprising heating the canister and its contents and maintaining a sufficiently elevated temperature during the application of axial pressure to the canister to cause the formation of synthetic rock and the discharge of gases.

PREFERRED FEATURES OF THE INVENTION

The method preferably extends to connecting the discharge duct of the canister to an exhaust gas processing system whereby any necessary processing steps such as filtering of radioactive gasses can take place.

Preferably, the discharge duct is arranged to co-operate with a filter structure capable of retaining good gas permeability at high temperature, with the filter being arranged to prevent any solid material escaping from the canister during densification of material being compressed therein.

The filter structure advantageously comprises a cap-like structure having apertures therein and co-operating with a base end wall of the canister which has an aperture therein leading to the discharge duct, a incorporating a filter material whereby ingress of synthetic rock forming materials into the filter during compression of the canister is substantially avoided.

The discharge duct is preferably in the form of a bore extending through the base end wall of the canister and terminating in a pipe adapted to be connected to a gas processing system. Alternatively, the discharge duct could be provided by a slot-like recess in the bottom of the base end wall of the canister, the duct in an operating position being closed by co-operation with an upper face of a pressure pad located on the hydraulic ram.

The canister optionally may include a cylindrical screen confining the particulate rock forming material and radioactive waste to a central zone of the canister and preventing the ingress of this material into the region of the convolutions of the bellow-like structure in the cylindrical side wall. The zone between the exterior of the screen and the convoluted side wall could be left free of solid material or alternatively could receive granulated Zircaloy from spent nuclear fuel rods. In either case removal of gas from the region between the screen and the convoluted wall portion can be provided by apertures in the base end wall of the canister connecting to the discharge duct.

In one important embodiment, the discharge duct terminates in a pipe which communicates with a gas extraction manifold, for example by the aperture at the end of the pipe being disposed adjacent the opening to the manifold, a suction being maintained to cause reliable scavenging of all discharged gases.

One form of this outlet pipe is an L shaped pipe fitting having a horizontal limb rotatably mounted in sealing engagement in the base end wall of the canister and connected to the discharge duct; the arm of the L-shaped pipe fitting extending at right angles to this horizontal arm is adapted to be rotated from a upwardly directed transport position to a downwardly directed location by pivotal action whereby the open tip of the pipe is inserted through a slot in a side wall of an upwardly directed tube forming the manifold for the extraction system. This tube is conveniently attached to the side of the pressure pad structure of the hydraulic ram. Other configurations can be used.

BRIEF DESCRIPTION OF THE DRAWINGS

Embodiments of the present invention will now be described by way of example and with reference to the accompaning drawings in which;

FIG. 1 is a plan view of a compressible, bellowstype container incorporating a first embodiment of the present invention;

FIG. 2 is an elevation, in partial section, of the container shown in FIG. 1;

FIGS. 3A and 3B are respective elevations showing in detail alternative filter arrangements for the filter structure shown in FIGS. 1 and 2;

FIGS. 4A and 4B are respective elevations of the arrangements shown in FIGS. 1 and 2 but incorporating a further inventive feature concerning a gas discharge system.

DETAILED DESCRIPTION OF THE DRAWINGS

Referring firstly to FIGS. 1 and 2 of the drawings, there is shown a compressible, bellows-type metal canister 1, for use in a hot pressing process for immobilising high level radioactive nuclear waste material in the form of a synthetic rock. The canister typically is generally as described in U.S. Pat. No. 4,645,624. The canister includes a gas filter and discharge arrangement constituting one embodiment of the invention. The canister 1 comprises a base wall 2 and a corrugated bellows like side wall 3 of generally circular cross-section. Concentrically arranged within the corrugated side wall 3 is a cylindrical liner 4. In the centre of the base wall 2 is located a conically-tapered aperture 5 provided with a filter plug shown diagrammatically at 6. Between the corrugated side wall 3 and inner liner 4 of the canister are provided two further, diametrically-opposed apertures 7. All three apertures 5, 7 are connected by an outlet pipe 8 extending diametrically across the base wall 2 and exteriorly of the canister. This outlet pipe 8 is connectable to any suitable waste disposal system, as will be described hereinafter with respect to a preferred embodiment.

Referring now to FIGS. 3A and 3B, there are shown two alternative embodiments of filter plug 6 which may be used in association with the central aperture 5 in the base wall 2 of the compressible canister 1.

The filter plug 6 in FIG. 3A comprises an inverted castellated cap 9 with which is associated a filter mass 10 made of alumina or titania fibre. This filter material is packed into the conically-tapered aperture 5 and into the gaps between the castellations of the cap 9. The projecting lugs of the castellated cap 9 rest on the upper surface of the base wall 2 around the periphery of the conical aperture 5 and thus compressive forces in the axial direction of the canister are absorbed and ingress of synthetic rock forming components into the filter structure are substantially avoided.

The filter plug 6 shown in FIG. 3B differs from that of FIG. 3A only in that it has a filter disc 10' made of Hastalloy in place of the mass of alumina or titania fibre. The filter disc 10' is welded around its periphery as shown at 16 to the conical-aperture 5. Furthermore, in the embodiment of FIG. 3B the outlet duct 8 is formed by the co-operation of a slot in the underside of the base wall 2, the duct being closed on its lower side by co-operation with the uper face of pressure pad 12 resting on a hydraulic ram.

The discharge of gases through the outlet duct 8 can be to a gas processing system of the type described below with reference to FIGS. 4A and 4B. The gases will comprise the gas in the interstices of the particulate material in the canister and any volatile components produced from the particulate material during the heating stage.

As shown in FIGS. 4A and 4B, the outlet pipe 8 (or outlet duct) is connected to an outlet tube 11. In FIG. 4A, the compressible canister 1 is shown in a free-standing position upon a lower pressure pad 12 of a hydraulic press associated with an induction furnace (not shown) in which the canister is to be heated to a high temperature and then compressed axially. In this arrangement, the outlet tube 11 is L-shaped and has its horizontal limb rotatably but sealingly mounted in a side of the base wall 2; the terminal limb in the illustrated loading position extends upwardly, with its open end free to the atmosphere.

In the process, as shown in FIG. 4B, the compressible bellows-type canister 1 is raised by the hydraulic ram to place the upper wall 17 of the canister against a fixed refractory abutment pad 13. The canister is thus positioned so as to be heated in the induction furnace (not shown) which surrounds the canister. However, before heating can commence, the outlet tube 11 is rotated through 180° into a downwardly extending position, such that the terminal limb extends into a manifold arrangement 14 communicating with an exhaust tube 15, which is connected to a low pressure gas filtration system. It is to be noted that the manifold arrangement 14 and associated down pipe 15 are mounted on the lower pressure pad 12, so that they can move in unison with the exhaust tube 11 and canister 1 supported on that pad.

Although the high level radioactive nuclear waste incorporated into the synthetic rock materials includes elements volatile at the typical temperatures to which the material is heated (about 1150° C.) it has been fund that little, if any of these components are infact exhausted from the canister; it is thought these volatile components are absorbed into the synthetic rock materials. However, in order to maximize safety aspects it is proposed to collect all gases discharged through the outlet duct 8. The filter structure has a filter material for preventing the ejection of any particulate matter from the canister which might be entrained with the gases. Due to the gae collection system shown in FIGS. 4A and 4B the gaseous stream can be filtered and any radioactive components removed.

FIG. 4A shows the loading postion. For transportation the terminal limb 11 of the outlet duct is directed upwardly to prevent damage or catching on any objects. After positioning of the canister 1 on the pressure pad 12, the limb is rotated downwardly to engage in the slotted open end of manifold 14 which together with discharge pipe 15 are fixed to the side of the pressure pad 12.

Other configurations for discharge pipe connections could be utilised. Simply, reliable connections are important and one uesful alternative is to provide a V-shaped slot in opposite walls at the end of manifold 14 and to raise the manifold and orientate it so that it engages a side wall of a fixed discharge tube 11 and bridges across a portion of the side wall of the discharge tube having a gas discharge aperture.

We claim:

1. A method of forming synthetic rock incorporating radioactive waste wherein precursor materials for the synthetic rock mixed with radioactive waste are placed in a metal canister, the wall of which includes a bellows like wall structure, the method comprising heating the canister and its contents and maintaining a sufficiently elevated temperature during the application of axial pressure to the canister to cause the formation of synthetic rock and the discharge of gases, and characterised by using a canister including a discharge duct connected to an exhaust gas processing system for discharging gases from within the canister.

2. The method according to claim 1, wherein upstream of the discharge duct a filter structure is provided within the canister and the filter structure retains good gas permeability at high temperature and prevents any solid material escaping from the canister during densification of material being compressed therein.

3. The method according to claim 2, wherein the filter structure comprises a cap-like structure having apertures therein and co-operating with a base end wall of the canister which has an aperture therein leading to the discharge duct, a cavity being defined between the aperture and the cap and incorporating a filter material whereby ingress of synthetic rock forming materials into the filter during compression of the canister is substantially avoided.

4. The method according to claim 1, wherein the discharge duct is in the form of a bore extending through a base end wall of the canister and terminating in a pipe adapted to be connected to a gas processing system.

5. The method according to claim 1, wherein the discharge duct is in the form of a slot-like recess in the bottom of a base end wall of the canister, the discharge duct is an operating position being closed by co-operation with an upper face of a pressure pad located on the hydraulic ram.

6. The method according to claim 1, wherein a cylindrical screen is provided confining the particulate material to a central zone of the canister and preventing the ingress of this material into the region of the convolutions of the bellows like structure in the cylindrical side wall.

7. The method according to claim 1, wherein the discharge duct terminates in a pipe which communicated with a gas extraction manifold and a suction is applied to enable reliable salvaging of all discharged gas.

8. The method according to claim 7, wherein the pipe is an L-shaped pipe fitting having a horizontal limb rotatably mounted in sealing engagement in the base end wall of the canister and connected to the discharge duct; an arm of the L-shaped pipe fitting extending at right angles to this horizontal limb is adapted to be rotated from an upwardly directed transport position to a downwardly directed location by pivotal action whereby an open tip of the pipe is inserted through a slot in a side wall of an upwardly directed tube which forms the manifold for the extraction system.

9. A method of forming synthetic rock incorporating radioactive waste wherein precursor materials for the synthetic rock mixed with radioactive waste are placed in a metal canister, the canister as being claimed in claim 1, the method comprising heating the canister and its contents and maintaining a sufficiently elevated temperature during the application of axial pressure to the canister to cause the formation of synthetic rock and the discharge of gases.

* * * * *